US007156134B1

(12) United States Patent
Brakefield et al.

(10) Patent No.: US 7,156,134 B1
(45) **Date of Patent: *Jan. 2, 2007**

(54) FUEL TRANSFERRING SYSTEM AND METHOD OF USE

(75) Inventors: Michael C. Brakefield, Yukon, OK (US); Steven K. Olive, Oklahoma City, OK (US); Steven C. Strobel, Clarks, NE (US)

(73) Assignee: Musket Corporation, Oklahoma City, OK (US)

( * ) Notice: Subject to any disclaimer, the term of this patent is extended or adjusted under 35 U.S.C. 154(b) by 111 days.

This patent is subject to a terminal disclaimer.

(21) Appl. No.: 10/874,807

(22) Filed: Jun. 21, 2004

Related U.S. Application Data

(63) Continuation-in-part of application No. 10/601,062, filed on Jun. 20, 2003, now Pat. No. 6,945,288.

(51) Int. Cl.
*B65B 1/04* (2006.01)

(52) U.S. Cl. ..... 141/231; 141/67; 141/83

(58) Field of Classification Search ..... 141/231, 141/67, 95, 198, 115, 116, 83; 222/208; 137/355.12; 417/234; 280/830–839
See application file for complete search history.

(56) References Cited

U.S. PATENT DOCUMENTS 6,945,288 B1 * 9/2005 Brakefield et al. ..... 141/231

* cited by examiner

*Primary Examiner*—Steven O. Douglas
(74) *Attorney, Agent, or Firm*—McAfee & Taft

(57) ABSTRACT

A portable system for transferring liquids, such as diesel fuel, from a first tank, such as a railcar, to a second tank, such as on a transport truck. The system is self-contained and comprises a pump driven by an engine fueled by the liquid being transferred. A meter measures the amount of liquid being transferred. An inlet hose is used to connect the system to the railcar, and an outlet hose is used to connect the system to the transport truck. The inlet and outlet hoses may be stored in hose storage tubes. A throttle of the engine may be actuated from a rear portion of the system. A sample line is provided through which a sample may be taken of the liquid being transferred. Air from the truck may be used to blow any liquid out of the outlet hose after a transferring operation.

49 Claims, 5 Drawing Sheets

FUEL TRANSFERRING SYSTEM AND METHOD OF USE

This is a continuation-in-part of application Ser. No. 10/601,062 filed Jun. 20, 2003 now U.S. Pat. No. 6,945,288.

BACKGROUND OF THE INVENTION

1. Field of the Invention

This invention relates to equipment for unloading petroleum products such as diesel fuel from one storage or transport tank to another, such as from a railcar to a transport trailer, and more particularly, to a portable system for unloading a railcar into a transport trailer without the necessity of any permanently installed equipment and which can be used at virtually any site at which access to the railcar is available.

2. Brief Description of the Prior Art

The use of railroad tank cars for bulk transportation of petroleum products, such as diesel and other fuels, is well known. It is also known to transport such fluids over the highways by truck using specially designed transport trailers, often called tanker trailers.

The railcars have top openings therein through which the railcars can be filled or loaded and bottom openings through which they can be emptied or unloaded. A valve on the bottom opening is used to open and close it. Normally, loading the railcar is done at a refinery site. When the railcars travel to an unloading terminal, permanent equipment is used to unload the railcar and transfer the product therein to another vessel of some sort. This might be a stationary storage tank, but often is a transport trailer. Both the stationary tanks and the tanks on the transport trailers also have openings therein with valves controlling them through which these vessels can be loaded and subsequently unloaded. It is not uncommon for these tanks to have separate compartments for different products, for example, diesel fuel and gasoline. Separate openings and valves are used for the different compartments.

When transferring a liquid such as diesel fuel, the previously mentioned permanent system is used. Such a permanent system includes a pump, usually driven by an explosion-proof electric motor and a meter downstream of the pump to measure and frequently record the amount of fuel transferred. An inlet hose is connected between inlet piping to the pump and the valve on the railcar, and an outlet hose is connected between outlet piping from the meter and the desired valve on the transport trailer. These hoses may have grounding wires woven therein so that when they are connected to metal piping, valves, etc., the chance of static electricity is minimized. This is necessary because a small spark could ignite the products being transferred or at least vapors therefrom.

In these prior art permanent installations, obviously it is necessary to take the transport trailer to the terminal to which the railcars have been brought. The unloading of the product from the railcar cannot take place anywhere else. Therefore, if is desired to unload the railcar at any other site, the permanent system is unusable. Thus, there is a need for a system which can be used to transfer product from a railcar when it is parked at a site which does not have an unloading terminal located there. The present invention solves this problem by providing a portable transferring and unloading system mounted in a small trailer which can be taken to virtually any site at which a transport trailer can be located near the railcar.

In permanent installations, although some lengths of hoses are used, most of the piping is fixed, and it does not matter if fluids remain therein after a transferring or pumping cycle. Any spillage is caught in permanent areas around the system. In the portable system of the present invention there is a relatively small amount of fixed piping in the trailer, and most of the connections between the railcar and the transport trailer are with flexible hoses. When the pumping is done, the outlet hose will still be full of fluid. After disconnecting such a hose, the hose would be extremely heavy and difficult to handle and there would be spillage of some, if not most, of the liquid in the hose. This not only would waste valuable product, such as diesel fuel, but such spills would be detrimental to the environment and most likely would violate environmental laws or regulations. The present invention solves this problem by providing a connection in the outlet of the system whereby pressurized air from the truck is used to blow the remaining liquid out of the outlet hose and into the transport trailer.

In today's petroleum market, prices can fluctuate significantly depending on economic and world conditions and events. Marketers of petroleum products, such as diesel fuel, want to find the fuel at the least possible price in order to have a competitive advantage, or at least to be competitive with other marketers. Often, a lower price might be found at some distance away from the marketer's normal supply point. In such cases, marketers may take their transport trucks to those more remote locations to load with petroleum products if the cost of transportation is not prohibitive. This still requires the transport truck to be taken to a terminal where railcars are being unloaded, and this may add more cost than can be absorbed by the marketer. Also, even once at the terminal, it may take some time for a particular transport truck to be filled if a number are waiting. If unloading could be speeded up, this would be an advantage for everyone. Further, sometimes the railcars are still at a siding somewhere and not yet located at a terminal, and currently, this means they cannot be unloaded until they are moved to a terminal. This may result in a time delay which increases the cost of transportation for the suppliers who move the products by rail. If railcars could be unloaded earlier, the supplier would get paid sooner, and the railcar could be turned around more quickly to be reloaded. Also, if unloading could be accomplished more quickly, marketers might be able to buy it at a lower price and get the petroleum into the marketing stream earlier. All of this would improve cash flow at all levels of the petroleum market, from the supplier to retail consumers.

The present invention provides such an economic improvement because it can be used by the marketer to unload railcars and load transport trucks more quickly at terminals and even do this where there is no terminal because the inventive system is portable and self-contained.

SUMMARY OF THE INVENTION

The present invention includes a portable system for unloading fluids such as diesel fuel from one tank to another such as from railcars to transport trailers of the type pulled by trucks. The entire system is self-contained, and no permanent equipment at the unloading site is necessary. Thus, the transfer can take place at any location where the transport trailer can be positioned near the railcar, and it is not necessary to move the railcar to a specific unloading terminal.

The invention may be described as a portable system for transferring a liquid from a first tank such as a railcar to second tank such as a transport trailer in which the system comprises a trailer adapted for connection to a vehicle, a pump mounted on the trailer and having an inlet and an outlet, an engine mounted on the trailer and adapted for driving the pump, a flow meter mounted on the trailer and having an inlet in communication with the outlet of the pump and an outlet, a length of inlet hose connectable between the railcar and the inlet of the pump, and a length of outlet hose connectable between the outlet of the meter and the tank. The connection between the pump and meter is such that liquid pumped by the pump flows through, and is measured by, the meter.

A hose storage tube is disposed in the trailer and adapted for receiving at least one of the lengths of inlet and outlet hose therein. In one preferred embodiment, the length of inlet hose is one of a plurality of lengths of inlet hose connectable together by a coupling, the length of outlet hose is one of a plurality of lengths of outlet hose connectable together by a another coupling, and the hose storage tube is one a plurality of hose storage tubes. Each hose storage tube preferably has a closed end and an open end. The open end faces rearwardly with respect to the trailer.

The engine runs on the same liquid as that being transferred. Preferably, the engine is a diesel engine, and the liquid is diesel fuel. Some of the fuel is used to fill the fuel tank of the engine so that a separate fuel supply is unnecessary.

The engine has a throttle control which is accessible for a rear portion of the trailer. The engine also has an air inlet connected outside of the trailer and an exhaust which discharges outside of the trailer.

The engine is mounted on a plurality of mounting stabilizers which absorb vibrations generated by the engine and prevent the vibrations from being transmitted to the pump and other components of the system.

The system may further comprise an outlet air line with an outlet valve therein in communication with the outlet of the meter and an outlet air hose connectable between the outlet air line and an air source, whereby liquid in the outlet hose may be forced by air pressure into the tank.

The system may additionally comprise an inlet air valve connected to an end of the inlet hose and an inlet air hose connectable between the inlet air valve and an air source, whereby liquid in the inlet hose may be forced by air pressure toward the pump.

The system may additionally comprise a sample line connected to the outlet of the meter through which a sample of the liquid being transferred may be taken. A sample valve is provided to control flow through the sample line.

In the preferred embodiment, the tank is a portion of a transport trailer on a transport truck, and the air source is mounted on the truck.

The hoses are preferably grounding hoses with a grounding wire woven therein.

The system may further comprise a monitor and alarm connected to the second tank for providing an audible signal indicating a predetermined liquid level, such as the maximum desired level, in the second tank. A switch may used to control the monitor and alarm.

The present invention also may be described as including a method of obtaining fuel at an optimum price comprising the steps of (a) locating a source of supply of the fuel at an acceptable price and contained in a railcar at a location accessible by a motor vehicle, (b) moving a portable liquid transferring system having a pump driven by an engine to the location, (c) moving a transport truck to the location, (d) connecting the system to the railcar and transport truck, (e) activating the system to pump the fuel from the railcar to the transport truck and varying the speed of the engine to drive the pump at a desired flow rate, (f) disconnecting the system from the railcar and transport truck, and (g) moving the transport truck to the desired marketing point. Step (d) preferably comprises connecting an inlet hose between the railcar and the system and connecting an outlet hose between the system and the transport trailer.

Step (b) preferably comprises storing the inlet and outlet hoses in hose storage tubes.

Step (e) may comprise actuating an engine throttle actuator from a rear portion of the system.

Step (e) may also comprise taking a sample of the fuel being transferred.

Between steps (e) and (f) the method may further comprise blowing liquid out of the inlet and outlet hoses by applying air pressure thereto. The air may be supplied by an air system on the transport truck.

Step (e) may comprise sounding an audible alarm when the fuel in the transport truck reaches a predetermined level.

Numerous objects and advantages of the invention will become apparent as the following detailed description of the preferred embodiment is read in conjunction with the drawings illustrating such embodiment.

DETAILED DESCRIPTION OF THE PREFERRED EMBODIMENT

Figure 1:
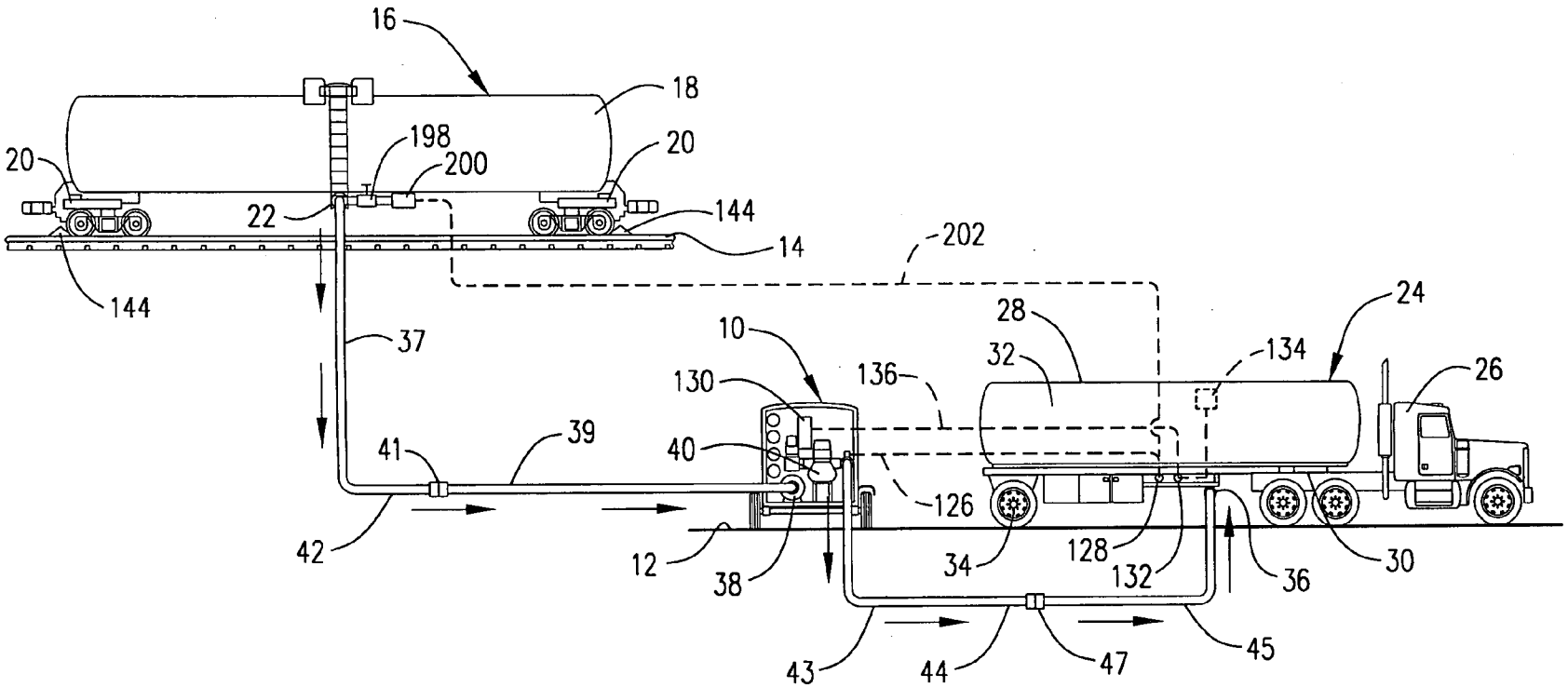
FIG. 1 shows the diesel fuel transferring system of the present invention connected between a railcar and a transport trailer.

Referring now to the drawings, and more particularly to FIG. 1, the diesel fuel transferring system of the present invention is shown and generally designated by the numeral 10. System 10 is shown positioned on a ground surface 12 adjacent to railroad tracks 14. FIG. 1 is for illustration purposes only, and it is not intended to convey the impression that tracks 14 are at a higher elevation than ground surface 12. No specific relative height is necessary for system 10 to be used.

A railroad tank car 16, also referred to simply as railcar 16, is positioned on tracks 14. Of course, more than one railcar 16 may be present at any time. Railcar 16 is of a kind known in the art and has a tank 18 mounted on rail trucks 20. At the bottom of tank 18 is a railcar valve 22 through which the liquid in the tank may be emptied or unloaded.

Positioned adjacent to system 10 on ground surface 12 is a transport truck 24 of a kind known in the art. Transport truck 24 has a tractor 26 connected to a transport trailer 28 by a fifth wheel 30. Transport trailer 28 includes a tank 32 mounted on rear wheels 34. Tank 32 has a transport valve 36 on the bottom thereof through which the tank may be filled or loaded with liquid or through which the tank may be emptied or unloaded. Although tank 32 is illustrated for simplicity as having a single transport valve 36 thereon, transport trailer tanks typically have multiple liquid compartments therein with a separate transport valve for each.

System 10 comprises, among other things, a pump 38 and a flow meter 40. The inlet of meter 40 and the outlet of pump 38 are connected to one another as will be further described herein. During operation of system 10, railcar valve 22 is connected to the inlet of pump 38 with an inlet hose 42, and the outlet of meter 40 is connected to transport valve 36 by an outlet hose 44. For ease of storage, inlet hose 42 may be made of a plurality of lengths of hose, such as lengths 37 and 39 connected together at a coupling 41 to make the full length of inlet hose 42. Similarly, outlet hose 44 may be made of a plurality of lengths of hose, such as lengths 43 and 45 connected together at a coupling 47 to make the full length of outlet hose 44.

Figure 2:
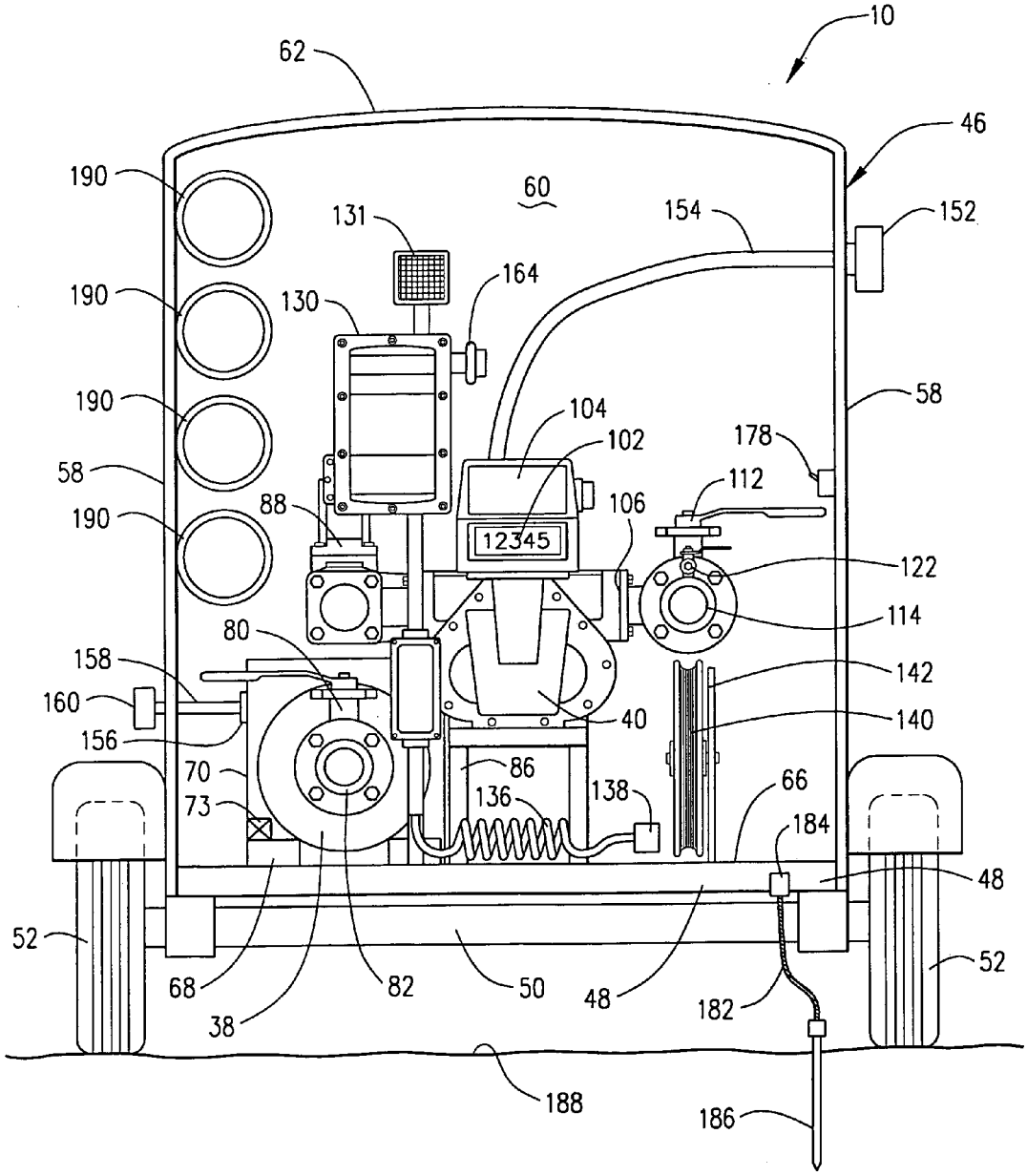
FIG. 2 is a detailed rear end view of the system.
Figure 3:
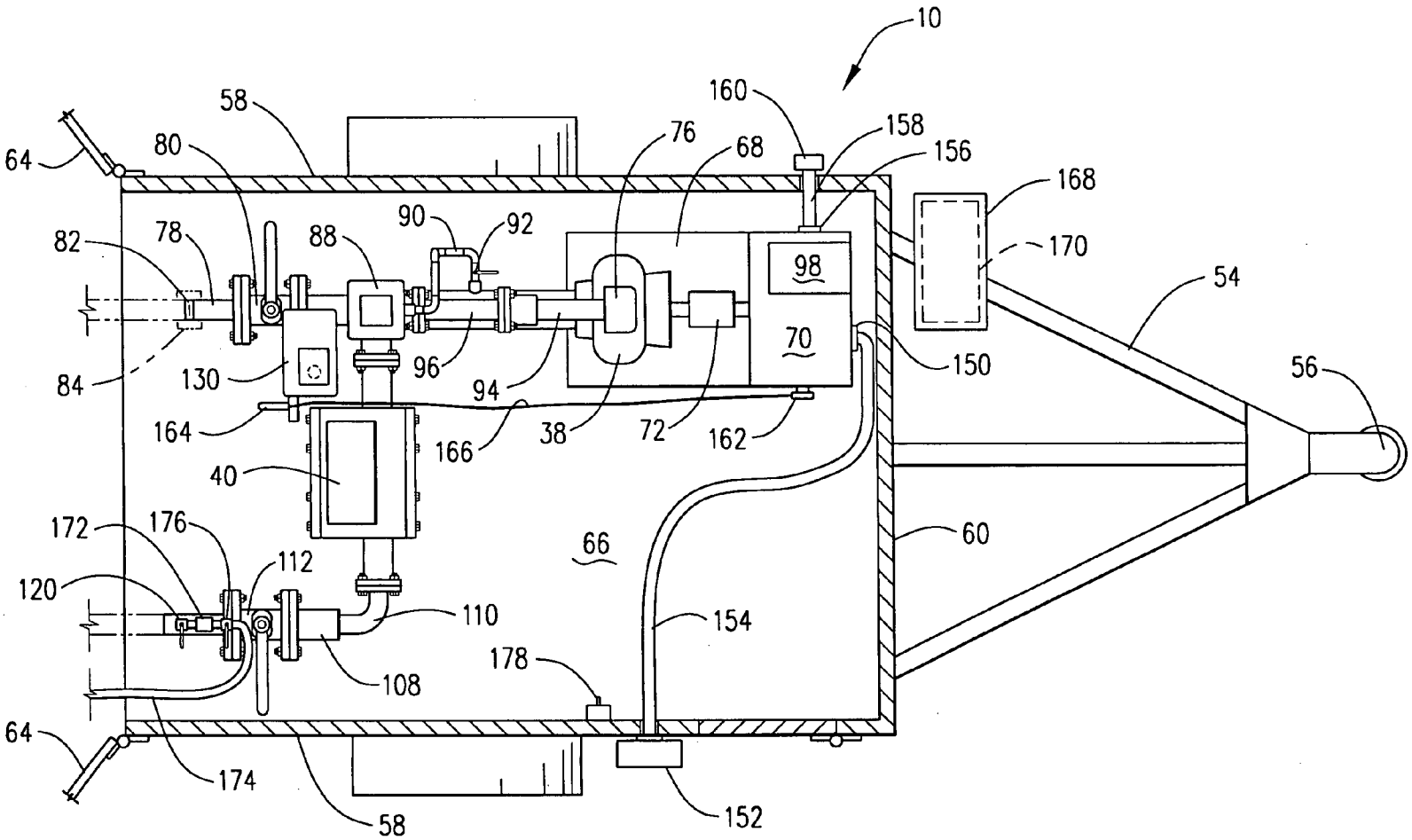
FIG. 3 shows a plan view of the system with the top of the trailer removed.
Figure 4:
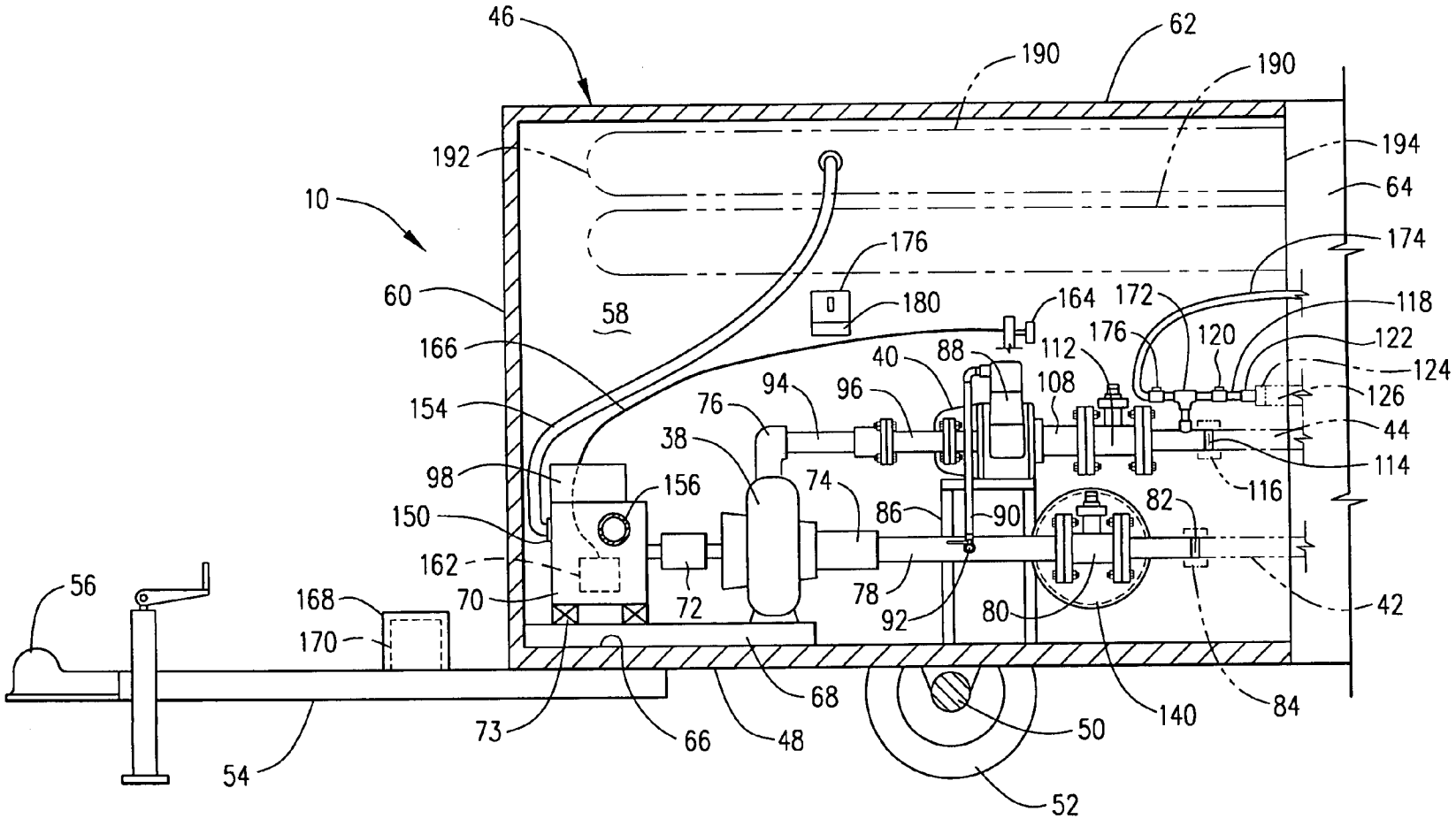
FIG. 4 is an elevation view of the system as seen from the left side of FIG. 2 with the side wall of the trailer removed.

Referring now to FIGS. 2–4, more details of system 10 will be discussed. System 10 also comprises a trailer 46 in which all of the other components are mounted. Trailer 46 is of generally conventional construction including a frame 48 mounted on an axle 50 and supported on wheels 52. A tongue 54 extends from frame 48 and has a hitch 56 for attachment to a vehicle (not shown) adapted for pulling trailer 46. Trailer 46 also has side walls 58 and a front wall 60 extending upwardly from frame 48 with a top 62 covering the trailer. Rear doors 64 are hingedly attached to side walls 58. A floor 66 extends across frame 48. A side door 67 may be provided in one of side walls 58 and hingedly attached thereto.

Pump 38 is installed on a pump base 68 mounted on floor 66. Adjacent to pump 38 on pump base 68 is a diesel engine 70 which drives pump 38 through a coupling 72. Engine 70 is mounted to pump base 68 by a plurality of mounting stabilizers 73. Mounting stabilizers 73 are shock absorbers or other vibration damping devices which absorb the vibrations generated by engine 70 and prevent or minimize those vibrations from being transmitted to trailer 46, pump 38 and the other components of system 10.

Pump 38 is illustrated as a centrifugal pump having a center inlet 74 and an outlet 76. One preferred pump 38 is a Gorman-Rupp 3×3 with 10 horsepower diesel engine Model No. 83A1-L100EE-X. However, other types of pumps could be used, and the invention is not intended to be limited to a centrifugal pump or any particular pump design or manufacturer.

An inlet line 78 is connected to pump inlet 74. An inlet valve 80 is disposed in inlet line 78. Preferably, but not by way of limitation, inlet valve 80 is a ball valve so that there is minimal pressure drop therethrough. At an end of inlet line 78 is a threaded inlet connector 82 of a kind known in the art. Inlet connector 82 is adapted for connection to a hose coupling 84 on the end of inlet hose 42.

Meter 40 is attached to a meter stand 86 mounted on floor 66. For the illustrated meter 40, pressure valve 88 forms part of the inlet of the meter. Pressure valve 88 is connected to inlet line 78 by a pressure valve line 90. Pressure valve line 90 has a valve 92 therein so that the pressure valve line may be opened and closed as desired, although it is normally open. Pressure valve 88 is of a kind known in the art designed so that only liquid passes through meter 40 and no vapor or air goes through in order to insure the accuracy of the meter.

A pump outlet line 94 connects pump outlet 76 with pressure valve 88 of meter 40. A flexible connector 96 may be included in pump outlet line 94 to compensate for any vibration from pump 38 and engine 70.

Engine 70 has a fuel tank 98 which is preferably filled with some of the liquid, such as diesel fuel, being transferred. That is, a portion of the fuel is poured into fuel tank 98. In this way, engine 70 is provided with fuel from the system without the necessity of a separate fuel source. It will be seen that this adds to the total portability and independent operation of system 10. One preferred engine is the above-referenced 10 horsepower diesel engine with the Gorman-Rupp pump, but many types of engines could be used.

Engine 70 has an air inlet 150 of a kind known in the art. An inlet filter 152 is mounted externally on trailer 46 to insure an adequate supply of clean ambient air and is connected to air inlet 150 by an air inlet line 154.

Engine 70 also has an exhaust 156 of a kind known in the art. To prevent the build-up of heat and exhaust fumes in trailer 46, exhaust 156 is ducted externally of the trailer by an exhaust line 158. A muffler or other sound damping device 160 may be attached to the external end of exhaust line 158.

Engine 70 further has a throttle 162 of a kind known in the art. To facilitate operation of system 10, a remote throttle actuator 164 is mounted in a rearward portion of trailer 46 adjacent to hereinafter-described monitoring system 130. Actuator 164 is connected to throttle 162 on engine 70 by a throttle cable 166. Pulling or pushing on actuator 164 will cause corresponding movement of throttle 162 which increases or decreases the speed of engine 70.

A battery box 168 is mounted on tongue 54 of trailer 46 and is thus outside of the trailer. Battery box 168 is adapted to hold a battery 170. Battery 170 is used to provide power to a starter (not shown) on engine 70 and also for internal lighting (not shown) in trailer. Battery box 168 protects battery 170 from the elements, and the positioning of the battery outside of trailer 46 minimizes any potential sparking problems in connecting battery where some petroleum vapors may be present in the trailer.

In addition to pressure valve 88, meter 40 is illustrated as one having a resettable digital readout 102 and a printer 104 for printing the amount of liquid passing through it on any particular operation. One preferred meter is the Liquid Controls (LC) Model No. LC M-30-C-1, although the invention is not intended to be limited to any particular meter. In particular, it is not intended that the invention be limited to a meter having a pressure valve on the inlet thereof. Other types of meters designed for the liquid being transferred will work in addition to the one shown.

Meter 40 has an outlet 106. An outlet line 108 is connected to meter outlet 106. Outlet line 108 has an elbow 110 and an outlet valve 112 therein. Outlet valve 112 is preferably a ball valve for minimal pressure drop therethrough, but other types of valves could be used. The invention is not intended to be limited by any particular outlet valve design.

Outlet line 108 has a threaded outlet connector 114 on an end thereof. Outlet connector 114 is adapted for connection to a hose coupling 116 on outlet hose 44.

Between outlet valve 112 and outlet connector 114, a tee 172 is in communication with outlet line 108. An outlet air line 118 is connected to one end of tee 172 and thus is in communication with outlet line 108. An outlet air valve 120 in outlet air line 118 allows control of communication between outlet air line 118 and outlet line 108. At an end of outlet air line 118 is an outlet air line connector 122. Outlet air line connector 122 is of a kind known in the art and is adapted for connection to an outlet air coupling 124 at one end of an outlet air hose 126. The other end of outlet air hose 126 is connectable to an air fitting 128 of a kind known in the art which is mounted on transport truck 24 and part of the standard air system of the truck.

At the connection of inlet hose 42 to railcar valve 22, and in communication with the inlet hose, is an inlet air valve 198. Connected to inlet air valve 198 is an inlet air line connector 200. Inlet air line connector 200 is of a kind known in the art the same or similar to outlet air line connector 122. Inlet air line connector 200 can be connected to air fitting 128 on transport truck 24 by an inlet air hose 202 in a manner similar to the connection of outlet air hose 126. In fact, outlet air hose 126 and inlet air hose 202 may be the same hose.

A sample line 174 is connected to the other end of tee 172 and is thus also in communication with outlet line 108. A sample valve 176 is disposed in sample line 174. When sample valve 176 is open, fluid samples may be taken of the fluid being transferred by system 10 as will be further described herein.

As previously mentioned, system 10 also includes a monitoring system 130. Monitoring system 130, also referred to herein as monitor 130, is used to alert the operator if the liquid level in tank 32 of transport trailer 28 exceeds a predetermined level. Transport trailer 28 has a standard electrical connector 132 thereon which is wired to an internal float switch 134, both of which are part of the electrical system of transport truck 24 and powered thereby. A cable 136 connected to monitor 130 has a plug 138 thereon which is adapted for connection to electrical connector 132. One known example of monitor 130 is the Scully Intellitrol Model No. 08909 IC-OG, although the invention is not intended to be limited to this particular monitoring system. In stationary applications, such monitors may be used to control valves in the pumping system, but this is not done in the portable system of the present invention. However, in system 10 an audible alarm 131 is connected to monitor 130 to alert the operator if the liquid level in transport trailer 28 is higher than desirable.

A switch 178 may be used to provide a remote shutdown of monitor 130 and alarm 131. Switch 178 may be mounted in any convenient location, such as to a side wall 58 of trailer 46 adjacent to side door 67. Instrumentation, such as an hour meter 180 (see FIG. 4), may be included as desired.

Also mounted in trailer 46 is a grounding cable 140 wound on a reel 142. Grounding cable 140 is grounded to the rest of system 10, such as to the piping and can be connected to a metal portion of transport trailer 28 to minimize the possibility of a static electrical spark when connecting system 10 for a pumping operation. Ordinarily, it is not necessary to connect grounding cable 140 because inlet hose 42 and outlet hose 44 preferably have metal wire woven therein so that they each act as grounding cables. Thus, grounding cable 140 is redundant in most cases, but is available if a grounded hose is not available.

Other grounding cables 182 may be used as necessary. See FIG. 2. Each cable 182 has a clip 184 on one end thereof adapted for attachment to a metal member such as frame 48 of trailer 46. The other end of grounding cable 182 has a spike 186 which can be driven into a ground surface 188 adjacent to system 10.

As best seen in FIG. 2, a plurality of hose storage tubes 190 are mounted to the upper portion of the interior of one of side walls 58 of trailer 46. Referring also to FIG. 4, in which two of hose storage tubes 190 are omitted for clarity, hose storage tubes 190 are elongated and have a closed end 192 adjacent to a forward end of trailer 46 and a rear-facing open end 194. Hose storage tubes are adapted to receive the various lengths 37, 39, 43 and 45 of the inlet and outlet hoses previously described. Thus, the lengths of hose are easily and quickly stored in trailer 46 without adding clutter to floor 66 thereof.

OPERATION OF THE INVENTION

Figure 5:
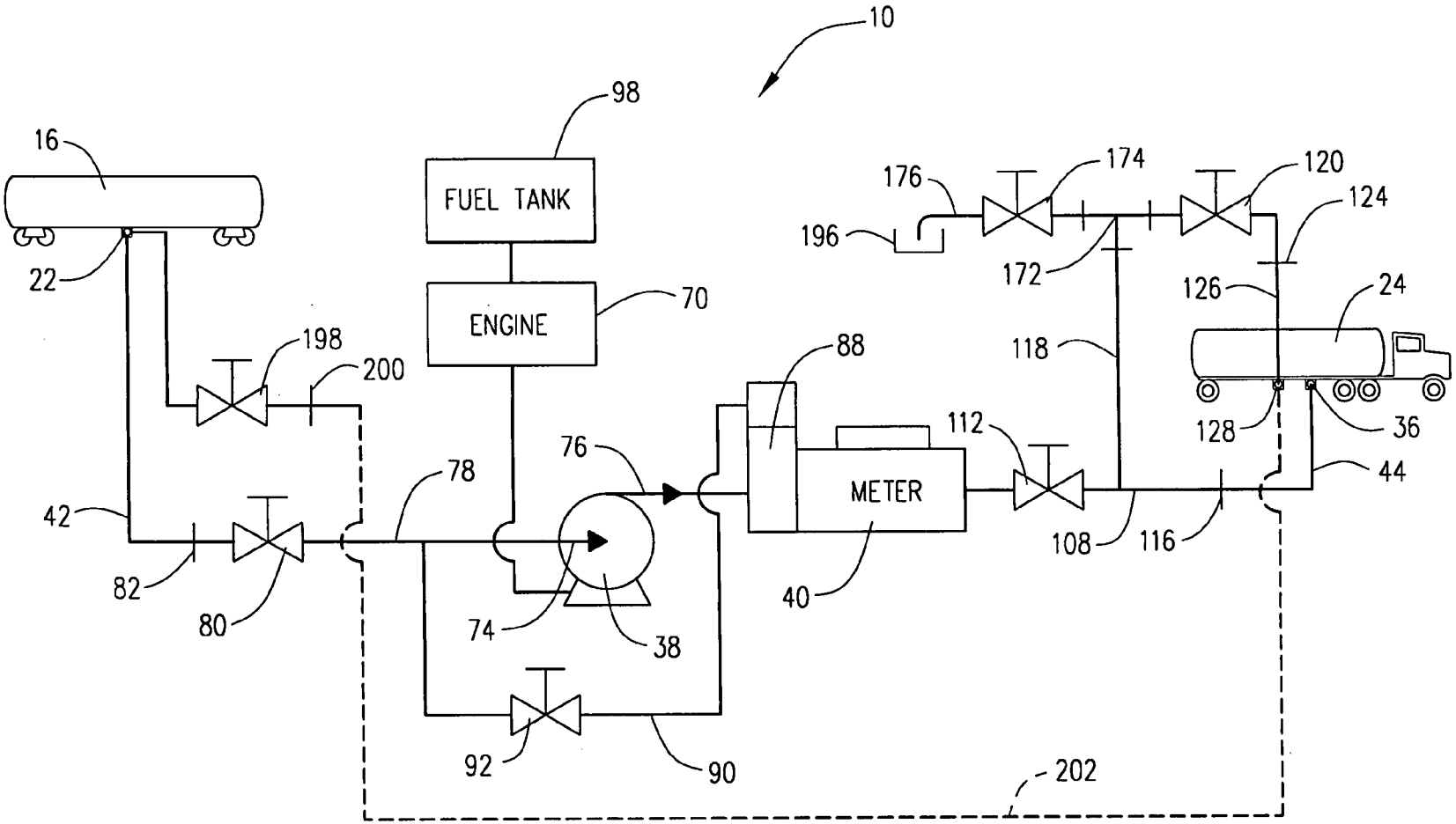
FIG. 5 is a flow schematic of the system when it is connected to a railcar and a transport trailer.

Referring now also to the flow schematic of FIG. 5, the method of operation of diesel fuel transferring system 10 will be discussed.

A petroleum marketer may do a survey of available sources of supply of fuels, such as diesel fuel, and find that a particular supplier has a railcar 16 filled with the desired product at an attractive price. With the present invention, it does not matter whether railcar 16 is located at an unloading terminal. In fact, it might be learned that the price of the product will be lower if the railcar can be unloaded without having to wait for it to be moved to a terminal and further wait its turn for unloading. The present invention makes it possible to do the unloading anywhere that system 10 and a transport truck 24 can be positioned near the railcar and thus to obtain the optimum price for the product.

Prior to connection of system 10, railcar valve 22, inlet valve 80, outlet valve 112, transport valve 36 and outlet air valve 120 are closed. Normally, valve 92 is left open and only closed when installing or doing maintenance on system 10.

Once system 10 and transport truck 24 are positioned near a railcar 16, connection of system 10 may be started. First, chocks 144 are placed for safety at each end of railcar 16 as seen in FIG. 1. Chocks 144 are easily stored in trailer 46.

Grounding cables 140 and/or 182 are connected as desired.

As previously mentioned, lengths 37 and 39 of inlet hose 42 and lengths 43 and 45 of outlet hose 44 are also normally stored in hose storage tubes 190 in trailer 46. However, in some cases, inlet and outlet hoses 42 and 44 may alternatively be carried on transport trailer 28 in the same manner as any hose can be carried thereon. Either way, lengths 37 and 39 of inlet hose 42 are taken out of storage, connected together at coupling 41 and connected to railcar valve 22 in a known manner, and inlet hose coupling 84 is connected to inlet connector 82 on system 10. Lengths 43 and 45 of outlet hose 44 are taken out of storage, connected together at coupling 47 and connected to transport valve 36 in a known manner, and outlet hose coupling 116 is connected to outlet connector 114.

Railcar valve 22, inlet valve 80, outlet valve 112 and transport valve 36 are then opened. If for some reason, valve 92 has been closed, it is opened as well. Outlet air valve 120 is left closed at this time.

Cable 136 from monitor 130 is connected to transport trailer 28 by plugging plug 138 into electrical connector 132.

Diesel engine 70 is started and its clutch, if any, engaged automatically or manually to start driving pump 38. It will be seen by those skilled in the art that system 10 thus acts to pump liquid out of railcar 16 and into transport trailer 28. Since the electrical and air systems are carried normally on transport truck 24, and because engine 70 uses the same fuel as that in system 10, the entire system is self-contained. The only limitation is that the operator be able to get system 10 and transport trailer 28 close enough to railcar 16 so that the connections can be made.

The operator can watch meter readout 102 to determine when enough liquid has been transferred. Monitor 130 will act to warn the operator if transport trailer 28 is being overfilled.

During the fluid transfer operation of system 10, the operator may easily vary the speed of engine 70 to the desired level by using remote throttle actuator 164 from the rear of trailer 46.

At any time after connecting system 10, a sample of the fluid being pumped may be taken. With outlet air valve 120 closed, sample valve 176 may be opened and sample line 174 directed to discharge into any desired container 196 (see FIG. 6). After filing container 196, tests may be made of the fluid sample. For example, but not by way of limitation, the specific gravity of the fluid may be checked.

When the desired amount of liquid has been loaded into transport trailer 28 and no more is to be unloaded from railcar 16, engine 70 is shut off to stop pump 38 and railcar valve 22 is closed. Inlet hose 42 is disconnected from railcar valve 22, and that end of the inlet hose is raised to allow the liquid therein to drain toward inlet valve 80. Engine 70 is restarted and pump 38 thereby allowed to operate a little longer in order to evacuate the liquid from inlet hose 42 as much as possible, at which point engine 70 is again shut off. At this time, inlet valve 80 and outlet valve 112 are closed. If further unloading of railcar 16 will be done at this time, it is not necessary to close railcar valve 22 or disconnect inlet hose 42. Also, it will be seen that if railcar 16 is emptied during the transfer operation, inlet hose 42 will be evacuated by leaving the pump running a few moments longer, thus making the manual draining step described above unnecessary. In any event, when disconnecting inlet hose 42, it is important to get the liquid out of inlet hose 42 to make it easier to handle for storage and to avoid any spillage of liquid into the environment.

In some cases, inlet hose 42 may not be fully evacuated by pump 38. For example, the walls of the hose might collapse from the suction provided by the pump which could prevent some of the liquid in the hose from getting to the pump. In such cases, inlet air hose 202 may be attached to inlet air line connector 200 and air fitting 128 on transport trailer 28. Inlet air valve is then opened to allow air pressure into inlet hose 42 to force all of the liquid toward pump 38.

Outlet hose 44 is emptied in a similar manner. After outlet valve 112 is closed, outlet air hose 126 is connected to outlet air line connector 122 and air fitting 128 on transport trailer 28. With sample valve 176 closed, outlet air valve 120 is then opened, and air pressure from the truck air system is applied to outlet hose 44 to force any liquid therein out of the outlet hose, through transport valve 36 and into tank 32 of transport trailer 28. Once outlet hose 44 is thus emptied, outlet air valve 120 is closed and outlet air hose 126 disconnected. Outlet air valve 120 may then be reopened to vent any air pressure from outlet hose 44, after which the outlet air valve is closed again.

Any time after railcar valve 22 and inlet valve 80 are closed following an unloading operation, inlet hose 42 may be disconnected from the railcar valve and inlet connector 82. Lengths 37 and 39 of inlet hose 42 are disconnected at coupling 41 and stored again in hose storage tubes 190 in trailer 46 or, alternatively, on transport trailer 28. Because the liquid was pumped out of inlet hose 42 as previously described, the inlet hose is not too heavy to handle and no significant amount of liquid is spilled into the environment. After the air pressure procedure described above, outlet hose 44 may be disconnected from outlet connector 114 and transport valve 36. Lengths 43 and 45 of outlet hose 44 are disconnected at coupling 47 and stored again in hose storage tubes 190 in trailer 46 or, alternatively, on transport trailer 28. Because the liquid was blown out of outlet hose 44 by air, the outlet hose is not too heavy to handle and no significant amount of liquid is spilled into the environment.

After disconnecting cable 136 from transport trailer 28 and, if necessary, disconnecting grounding cables 140 and/or 182, the unloading operation is complete. Transport truck 24 can then be driven to the desired point of distribution of the petroleum in it. System 10 can be used to further unload railcar 16 into another transport truck or easily moved to another location to unload a different railcar.

When desired, monitor 130 and alarm 131 may be turned off using switch 178.

It will be seen, therefore, that the diesel fuel transferring system and method of determining and obtaining a source of supply of petroleum products of the present invention are well adapted to carry out the ends and advantages mentioned as well as those inherent therein. While presently preferred embodiments of the system and method have been described for the purposes of this disclosure, numerous changes in the arrangement and construction of parts in the system and steps in the method may be made by those skilled in the art. All such changes are encompassed within the scope and spirit of the appended claims.

What is claimed is:

1. A portable system for transferring a liquid from a first tank to a second tank, the system comprising:

a trailer adapted for connection to a vehicle;

a pump mounted on the trailer and having an inlet and an outlet;

an engine mounted in the trailer and adapted for driving the pump;

a flow meter mounted on the trailer and having an inlet in communication with the outlet of the pump and an outlet, such that liquid pumped by the pump flows through, and is measured by, the meter;

a length of inlet hose connectable between the first tank and the inlet of the pump;

a length of outlet hose connectable between the outlet of the meter and the second tank; and a hose storage tube disposed in the trailer and adapted for receiving at least one of the lengths of inlet and outlet hose therein.

2. The system of claim 1 wherein:

the length of inlet hose is one of a plurality of lengths of inlet hose;

the length of outlet hose is one of a plurality of lengths of outlet hose; and the hose storage tube is one of a plurality of hose storage tubes.

3. The system of claim 1 wherein the hose storage tube has a closed end and an open end.

4. The system of claim 3 wherein the open end faces rearwardly with respect to the trailer.

5. The system of claim 1 further comprising a throttle control for the engine accessible from a rear portion of the trailer.

6. The system of claim 1 wherein the engine has an air inlet connected outside of the trailer.

7. The system of claim 1 wherein the engine has an exhaust which discharges outside of the trailer.

8. The system of claim 1 further comprising:

a monitor and alarm connected to the second tank for providing a signal indicating a predetermined liquid level in the second tank; and a remote switch controlling said alarm.

9. The system of claim 1 further comprising a grounding cable having an end attachable to the trailer and a stake adapted for being driven into a ground surface.

10. The system of claim 1 further comprising a sample line connected to the outlet line through which a sample of the liquid may be taken.

11. The system of claim 1 further comprising:

a battery for providing power to a starter on the engine; and a battery box in which the battery is disposed, the battery box being disposed outside of the trailer.

12. The system of claim 1 wherein the engine is mounted on a vibration damping device.

13. A portable system for transferring a liquid from a first tank to a second tank, the system comprising:

a trailer adapted for connection to a vehicle;

a pump mounted on the trailer and having an inlet and an outlet;

an engine mounted on the trailer for driving the pump, the engine comprising a throttle;

a throttle actuator mounted adjacent to a rear portion of the trailer by which the throttle of the engine may be controlled to vary the speed of the engine;

a flow meter having an inlet in communication with the outlet of the pump and an outlet;

an inlet hose connectable between the first tank and the inlet of the pump; and an outlet hose connectable between the outlet of the meter and the second tank.

14. The system of claim 13 wherein the actuator is connected to the throttle by a cable.

15. The system of claim 13 wherein the engine has an air inlet connected outside of the trailer.

16. The system of claim 13 wherein the engine has an exhaust which discharges outside of the trailer.

17. The system of claim 13 further comprising a hose storage tube disposed in the trailer and adapted for receiving at least a portion of at least one of the inlet and outlet hose therein.

18. The system of claim 17 wherein:

the inlet hose comprises a plurality of lengths of inlet hose;

the outlet hose comprises a plurality of lengths of outlet hose; and the hose storage tube is one of a plurality of hose storage tubes.

19. The system of claim 17 wherein the hose storage tube has a closed end and an open end.

20. The system of claim 19 wherein the open end faces rearwardly with respect to the trailer.

21. The system of claim 13 further comprising:

a monitor and alarm connected to the second tank for providing a signal indicating a predetermined liquid level in the second tank; and a switch for controlling said alarm.

22. The system of claim 13 further comprising a grounding cable having an end attachable to the trailer and a stake adapted for being driven into a ground surface.

23. The system of claim 13 further comprising a sample line connected to the outlet line through which a sample of the liquid may be taken.

24. The system of claim 13 further comprising:

a battery for providing power to a starter on the engine; and a battery box in which the battery is disposed, the battery box being disposed outside of the trailer.

25. The system of claim 13 wherein the engine is mounted on a vibration damping device.

26. A portable system for transferring a liquid from a first tank to a second tank, the system comprising:

a trailer adapted for connection to a vehicle;

a pump mounted on the trailer and having an inlet and an outlet;

an engine adapted for driving the pump;

a flow meter having an inlet connected to the outlet of the pump and an outlet;

an inlet hose connectable between the first tank and the inlet of the pump;

an outlet hose connectable between the outlet of the meter and the second tank;

a sample valve in communication with the outlet of the meter; and a sample line connected to the sample valve through which a liquid sample may be flowed when the sample valve is open.

27. The system of claim 26 further comprising a throttle control for the engine accessible from a rear portion of the trailer.

28. The system of claim 26 wherein the engine has an air inlet connected outside of the trailer.

29. The system of claim 26 wherein the engine has an exhaust which discharges outside of the trailer.

30. The system of claim 26 further comprising:

a monitor and alarm connected to the second tank for providing a signal indicating a predetermined liquid level in the second tank; and a remote switch controlling said alarm.

31. The system of claim 26 further comprising a grounding cable having an end attachable to the trailer and a stake adapted for being driven into a ground surface.

32. The system of claim 26 further comprising a hose storage tube disposed in the trailer and adapted for receiving at least a portion of at least one of the inlet and outlet hose therein.

33. The system of claim 32 wherein:

the inlet hose comprises a plurality of lengths of inlet hose;

the outlet hose comprises a plurality of lengths of outlet hose; and the hose storage tube is one of a plurality of hose storage tubes.

34. The system of claim 32 wherein the hose storage tube has a closed end and an open end.

35. The system of claim 34 wherein the open end faces rearwardly with respect to the trailer.

36. The system of claim 26 further comprising:

a battery for providing power to a starter on the engine; and a battery box in which the battery is disposed, the battery box being disposed outside of the trailer.

37. The system of claim 26 wherein the engine is mounted on a vibration damping device.

38. A portable system for transferring a liquid from a first tank to a second tank, the system comprising:

a trailer adapted for connection to a vehicle;

a pump mounted on the trailer and having an inlet and an outlet;

an engine adapted for driving the pump;

a flow meter having an inlet connected to the outlet of the pump and an outlet;

an inlet hose connectable between the first tank and the inlet of the pump;

an outlet hose connectable between the outlet of the meter and the second tank;

an air valve in communication with the inlet hose; and an air line connected between the air valve and an air source whereby liquid in the inlet hose may be forced by air pressure toward the pump.

39. The system of claim 38 further comprising a throttle control for the engine accessible from a rear portion of the trailer.

40. The system of claim 38 wherein the engine has an air inlet connected outside of the trailer.

41. The system of claim 38 wherein the engine has an exhaust which discharges outside of the trailer.

42. The system of claim 38 further comprising:

a monitor and alarm connected to the second tank for providing a signal indicating a predetermined liquid level in the second tank; and a remote switch controlling said alarm.

43. The system of claim 38 further comprising a grounding cable having an end attachable to the trailer and a stake adapted for being driven into a ground surface.

44. The system of claim 38 further comprising a hose storage tube disposed in the trailer and adapted for receiving at least a portion of at least one of the inlet and outlet hose therein.

45. The system of claim 44 wherein:

the inlet hose comprises a plurality of lengths of inlet hose;

the outlet hose comprises a plurality of lengths of outlet hose; and the hose storage tube is one of a plurality of hose storage tubes.

46. The system of claim 44 wherein the hose storage tube has a closed end and an open end.

47. The system of claim 46 wherein the open end faces rearwardly with respect to the trailer.

48. The system of claim 38 further comprising:

a battery for providing power to a starter on the engine; and a battery box in which the battery is disposed, the battery box being disposed outside of the trailer.

49. The system of claim 38 wherein the engine is mounted on a vibration damping device.

* * * * *